United States Patent [19]

Kitoh

[11] Patent Number: 4,723,859

[45] Date of Patent: Feb. 9, 1988

[54] NIB BODY TO FORM PLURAL LINES

[76] Inventor: Kazunori Kitoh, 5-23-7, Asakusa, Taitoh-ku, Tokyo, Japan

[21] Appl. No.: 804,593

[22] Filed: Dec. 4, 1985

[30] Foreign Application Priority Data

Dec. 8, 1984 [JP] Japan ..... 59-186576[U]

[51] Int. Cl.[4] ..... B43K 1/12; B43K 8/02

[52] U.S. Cl. ..... 401/199; 401/35; 33/41.4; D19/41; D19/55

[58] Field of Search ..... 401/199, 35; 33/41.4; 101/372; D19/36, 41, 54, 55

[56] References Cited

U.S. PATENT DOCUMENTS 2,453,201 11/1948 Cushman ..... 401/199 X

FOREIGN PATENT DOCUMENTS 140721 2/1935 Austria ..... 101/372
563673 11/1932 Fed. Rep. of Germany ..... 101/372
1350320 4/1974 United Kingdom ..... 401/199

*Primary Examiner*—Steven A. Bratlie

[57] ABSTRACT

The inventive nib body for marking pen is a polygonally prismatic rod-like body made of a porous and rigid material suitable for penetration of the marking ink. Each of the ridge lines formed between the polygonal, e.g. triangular or quadrilateral, end surface and the side surfaces serves as the line-drawing edge so that, when each of the edges has a different length from the others, lines of different widths can be drawn with different line-drawing edges by use of a single nib. Further, the line-drawing edge can be provided with one or more of notches and divided into sections so that the edge can be used for drawing, for example, a double-track line composed of two parallel lines.

4 Claims, 5 Drawing Figures

NIB BODY TO FORM PLURAL LINES

BACKGROUND OF THE INVENTION

The present invention relates to a nib body for a marking pen and a marking pen with the same or, more particularly, to a multi-purpose nib body for a marking pen having three or more different line-drawing edges so that lines of three or more different marking patterns can be drawn by use of a single marking pen provided with the nib mounted thereon.

As is known, various types of nib bodies for marking pens are used as mounted on the end of a marking pen, such as an underline marker, a graphic marker and the like according to the particular use of the marking pen. These conventional marking pen nibs are usually in the form of a cylindrical or rectangular rod-like body having the end shaped or ground into a chisel-like or spatula-like thin form to serve as a line-drawing edge. A marking pen nib of this type is used, as a matter of course, for drawing a line having a width determined by or identical with, the width of the chisel- or spatula-like edge which is not versatile when drawing a line having a different width or a double-track line, triple-track line or the like is desired. At best, certain measures are taken to adapt the pen nib for the purpose of drawing a line having a somewhat smaller width than that of the chisel-like line-drawing edge. It is usual with the conventional marking pen to use a plurality of pens each having a different nib respectively designed to draw a line of a specific width or pattern.

SUMMARY OF THE INVENTION

Accordingly, an object of the present invention is to provide a novel multi-purpose nib body for a marking pen with which lines of several different widths and/or patterns can be drawn according to need, including not only solid lines having different widths, but also non-solid lines such as double-track lines, triple-track lines, etc.

Another object of the invention is to provide a multi-purpose marking pen having versatility in the width or pattern of the lines drawn therewith by being provided with an improved nib mounted on the end thereof.

Thus, the marking pen nib of the invention is a porous but rigid prismatic body having a polygonal, e.g. triangular or quadrilateral, cross section of which each of the ridges formed between the side surfaces and the end surface is shaped into a line-drawing edge having a different width or different pattern as provided with one or more of notches from the others so that the line drawn by use of a line-drawing edge can be different from the lines drawn by using the other line-drawing edges in width or pattern.

DETAILED DESCRIPTION OF THE PREFERRED EMBODIMENTS

Figure 1:
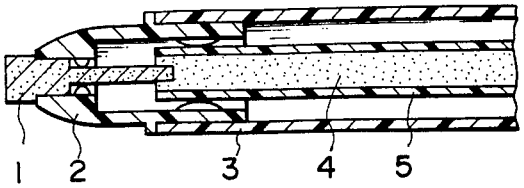
FIG. 1 is an axial cross sectional view of a part of a marking pen of the invention provided with the improved nib body.

As is mentioned above, the multi-purpose nib body for the marking pen of the invention is a prismatic body made of a porous but rigid material. The material should be porous in order that the marking ink held in the ink pool of the pen can penetrate the nib body by the capillary action to reach the line-drawing edges. It is preferable that the porosity is formed with a multiplicity of very fine capillaries or open cells communicating with each other. The cells should have a diameter in the range from 10 to 100 μm or, preferably, from 20 to 80 μm and the porosity should be in the range from 25 to 60% or, preferably, from 30 to 50% although the cell dimensions and the porosity should be determined according to the rheological behavior, e.g. viscosity, of the marking ink.

The material of which the porous nib body of the invention is formed is not particularly limitative provided that the nib body shaped thereof has appropriate rigidity not to cause undue deformation in the line drawing works therewith. Following are several of the methods for shaping the porous but rigid nib body of the invention though not limited thereto in any way.

(1) A powder of a thermoplastic resin is shaped and sintered into a desired form. Thus, particles of a thermoplastic resin, e.g. polyethylene, polypropylene. polyvinylidene fluoride and the like, having an average particle diameter in the range from 40 to 200 μm or, preferably, from 80 to 180 μm are packed into a cavity of a metal mold having a desired form of the nib body and partially sintered by heating under pressure. The pore diameter and the porosity can be controlled by suitably selecting the particle size distribution of the resin powder and the sintering conditions.

(2) A flux of bound filiments of a synthetic resin such as polyester acrylic resin, nylon and the like is dipped in a solution of a prepolymeric condensation-type resin such as melamine followed by drying and heating to cure the binder resin and the thus obtained resin-bound filament composite is mechanically worked into the desired form of the nib body.

(3) A thermoplastic resin is compounded with a relatively large volume of an inorganic filler such as calcium carbonate and the resin compound is shaped into a desired form of the nib body by the techniques of injection molding and the like followed by dissolution of the inorganic filler by use of a suitable chemical reagent such as hydrochloric acid for the calcium carbonate filler leaving open pores.

When at least a small portion of the surface of the thus shaped nib body, provided with adequate pore size distribution and porosity, is contacted with the marking ink held in the ink pool of the pen, the ink is readily absorbed by and penetrates throughout the nib body to fill the pores. Accordingly, lines can be drawn with full smoothness without blur when the nib body is contacted to and moved on the surface of an object body, e.g. paper, at either one of the line-drawing edges.

As is illustrated in the accompanying drawing, the end of the nib body, which should usually be prismatic having flat side surfaces at least in the very end portion, is usually cut in a plane substantially perpendicular to the longitudinal direction of the prismatic body to form a polygonal, e.g. triangular or quadrilateral, end surface to give three, four or more straight ridge lines with the side surfaces of the prismatic body. It is, however, optional that the end portion of the nib body is in a truncated pyramidal form making inclined facets. These ridge lines serve as the line-drawing edges of the inventive marking pen nib. The polygonal end surface, which may be a triangle, rectangle, pentagon, etc., may not be a regular polygon but can be irregular so that each of the ridge lines, i.e. line-drawing edges, may have a length different from those of the other ridge lines. Therefore, a single nib body of the invention is serviceable for drawing lines each having a different width from the others by using either one of the line-drawing edges.

Besides the above described nib body suitable for drawing solid lines having different widths, it is further optional that one or more of the line-drawing edges are provided each with one or more notches so that the edge no longer is a full continuous edge but divided in two or more sections. For example, a line-drawing edge provided with a notch is used for drawing a double-track line like railroad rails. When a line-drawing edge provided with two notches is used, a triple-track line can be drawn. Namely, the number, width and depth of the notches on the respective line-drawing edges are determined in accordance with the desired pattern of the line drawn therewith.

Although the line-drawing edges may be sharp as formed by cutting the end portion of the prismatic body, it is preferable that each of the edges is ground or chamfered to be imparted with roundness of a suitable curvature or a line-wise facet having a suitable width making a suitable angle with the longitudinal direction of the nib body in order to improve the smoothness in line drawing therewith.

The above described nib body for marking pen is inserted into the barrel of a marking pen typically made of a plastic resin and the rear end of the nib is contacted with the ink pool in the pen barrel which may be of any of conventional types including fiber fluxes, felted fiber pieces, sponges and the like soaked with the marking ink.

As is understood from the above description, the inventive nib body for marking pen as well as the inventive marking pen having the nib body mounted at the end are very useful in the versatility for drawing lines of different widths or different patterns, which can be drawn in the prior art only by use of a plural number of marking pens, by use of a single nib or pen so that great convenience is obtained in the draftsman's works as well as in any line-drawing purposes.

In the following, the inventive nib body for marking pen and the marking pen with the nib mounted thereon are described in more detail with reference to the accompanying drawing.

FIG. 1 illustrates an axial cross sectional view of a part of an inventive marking pen provided with the above described improved nib body mounted at the end thereof. The nib body 1 is inserted into the end opening of the nib holder 2 which in turn is inserted into the opening of the cylindrical pen barrel 3. The pen barrel 3 contains a cylindrical ink pool tube 5 therein filled with a felted fiber piece 4 soaked with marking ink to serve as the ink pool. The nib body 1 held by the nib holder 2 extends rearwardly into the hollow space in the pen barrel 3 and the rear end thereof goes a little into the opening of the ink pool tube 5 to be contacted with the ink-soaked felted fiber piece 4 as the ink pool. As a result of this contacting, the marking ink soaking the felted fiber piece 4 is absorbed into the nib body 1 and penetrates therethrough by the capillary action to reach the other end of the nib body 1 so that the line-drawing edges are ready to transfer the marking ink to the object body in contact therewith. As the nib body 1 is run on the object body to draw a line by the transfer of the ink, the pores of the nib body 1 are always filled up with the marking ink successively supplied from the ink pool by the capillary action.

FIGS. 2A to 2D each illustrate a perspective view of an inventive nib body which is generally an integral rod-like body of a porous but rigid material composed of a head 11 having a plural number of the line-drawing edges, an insertion 12 to be inserted into the opening of and held by the nib holder 2 and an ink conduit 13 to extend into the ink pool. The insert 12 is shaped to just fit the opening of the nib holder 2, usually, in a cylindrical form while the ink conduit 13, which is also usually cylindrical, should be as long as to ensure good contact with the ink pool which may be a felted fiber piece 4 in the ink pool tube 5. The head 11 of the nib body 1 has a flat end surface 14 substantially perpendicular to the longitudinal direction of the nib body 1 or the pen per se. The end surface 14 is polygonal, i.e. triangular, quadrilateral, etc., to have three, four or more of the sides each making a ridge line 15 with the side surface 16 which serves as the line-drawing edge.

Figure 2:
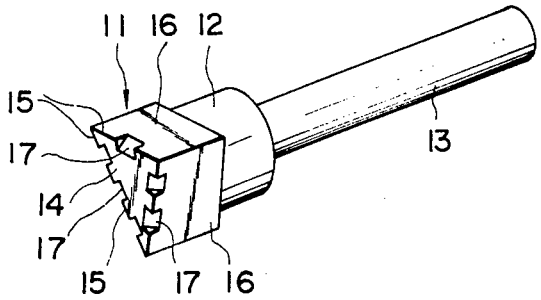
FIGS. 2A to 2D are each a perspective view of an inventive multi-purpose nib body for marking pen.
Figure 2:
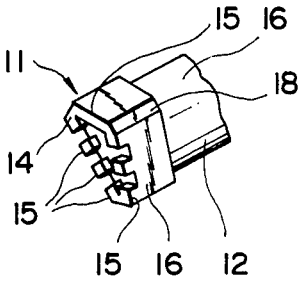
Figure 2:
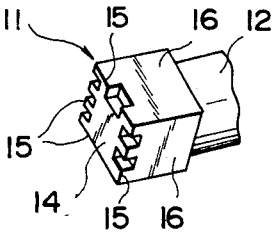
Figure 2:
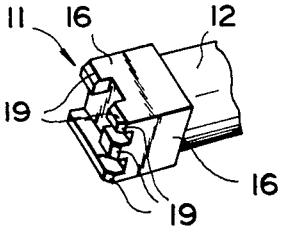

The head 11 of the nib body illustrated in FIG. 2A is in the form of a triangular prism having three side surfaces 16 each making a ridge line 15 with the triangular end surface 14. The ridge lines 15 which serve as the line-drawing edges are each provided with one, two or three notches 17. Namely, the line-drawing edges 15 provided with one, two and three notches 17 are usable for drawing a double-track, triple-track and quadruple-track lines, respectively.

FIG. 2B illustrates another nib body of the invention by a perspective view. The nib body is also in the form of a generally triangular prism with chamfered side ridges 18 having three line-drawing edges 15. In this case, one of the line-drawing edges 15 is left unnotched while the other two edges are provided with two or three notches so that this nib body is suitable for drawing a single solid line, three-track line and quadruple-track line by using either one of the three line-drawing edges 15. In this model, the end surface of the head 11 is not flat but the portion excepting the periphery is recessed.

FIGS. 2C and 2D each illustrate a perspective view of a nib body having a head 11 in the form of a quadrilateral or rectangular prism having four side surfaces 16 to form four line-drawing edges 15 which serve to draw a single solid line, double-track line, triple-track line and quadruple-track line in the nib body illustrated in FIG. 2C and a single solid line, two double-track lines, one with slender and widely spaced parallel lines and the other with bold and narrowly spaced parallel lines, and triple-track line in the nib body illustrated in FIG. 2D. The end portion of the head 11 of the nib body illustrated in FIG. 2D is not prismatic but in the form of a truncated pyramid forming four inclined facets 19.

What is claimed is:

1. A nib body for a marking pen comprising a porous rigid body of a prismatic rod-like form having at least three side surfaces and an end surface with a polygonal cross-section wherein individual line drawing edges are formed by a ridge between each side surface and the end surface and each line drawing edge comprises one or more sections, each of said sections being capable of drawing a line track, whereby each line drawing edge differs from the other line drawing edges on the nib body in either the number of sections or width of the section or sections and at least one line drawing edge on the nib body comprises plural sections, said plural sections being formed in a line drawing edge by one or more notches, each of said notches being localized to a single line drawing edge.

2. The nib body of claim 1, wherein one or more of said line drawing edges is chamfered.

3. A marking pen comprising a pen barrel and a nib body held at an end of the pen barrel, wherein the nib body is a porous rigid body of a prismatic rod-like form having at least three side surfaces and an end surface with a polygonal cross-section wherein individual line drawing edges are formed by a ridge between each side surface and the end surface and each line drawing edge comprises one or more sections, each of said sections being capable of drawing a line track, whereby each line drawing edge differs from the other line drawing edges on the nib body in either the number of sections or width of the section or sections and at least one line drawing edge on the nib body comprises plural sections, said plural sections being formed in a line drawing edge by one or more notches, each of said notches being localized to a single line drawing edge.

4. The marking pen of claim 3, wherein one or more of said line drawing edges is chamfered. I

* * * * *